US010508777B2

(12) United States Patent
McCane et al.

(10) Patent No.: US 10,508,777 B2
(45) **Date of Patent: *Dec. 17, 2019**

(54) LIGHT ENGINE RETROFIT KIT AND METHOD FOR INSTALLING SAME

(71) Applicant: ABL IP Holding LLC, Atlanta, GA (US)

(72) Inventors: Stephen Barry McCane, McDonough, GA (US); Forrest Starnes McCanless, Oxford, GA (US)

(73) Assignee: ABL IP Holding LLC, Atlanta, GA (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/788,853

(22) Filed: Oct. 20, 2017

(65) Prior Publication Data

US 2018/0066813 A1 Mar. 8, 2018

Related U.S. Application Data

(63) Continuation of application No. 14/741,243, filed on Jun. 16, 2015, now Pat. No. 9,822,937.
(Continued)

(51) Int. Cl.
*F21K 9/90* (2016.01)
*F21K 9/275* (2016.01)
(Continued)

(52) U.S. Cl.
CPC ..... *F21K 9/90* (2013.01); *F21K 9/20* (2016.08); *F21K 9/275* (2016.08);
(Continued)

(58) Field of Classification Search
CPC . F21K 9/275; F21K 9/272; F21K 9/90; F21K 9/27; F21K 9/20
See application file for complete search history.

(56) References Cited

U.S. PATENT DOCUMENTS 2,258,354 A 10/1941 Doane
2,259,151 A 10/1941 Claspy
(Continued)

FOREIGN PATENT DOCUMENTS

WO 2011008684 A2 1/2011
WO 2011008684 A3 4/2011

OTHER PUBLICATIONS

Non Final Office Action for U.S. Appl. No. 14/741,243, dated Jan. 27, 2017, 10 pages.
(Continued)

*Primary Examiner* — Anh T Mai
*Assistant Examiner* — Nathaniel J Lee
(74) *Attorney, Agent, or Firm* — Kilpatrick Townsend & Stockton LLP

(57) ABSTRACT

Retrofit kits for retrofitting LED light engines into existing light fixture housings. The retrofit kit includes a hook bracket that may be mounted in the housing and from which an end of the LED light engine can be suspended so as to permit an installer to electrically connect the LED light engine. The retrofit kit also includes a mounting bracket to secure the free end of the LED light engine into the housing after the LED light engine has been rotated upwardly into the housing from the hanging position.

20 Claims, 11 Drawing Sheets

Related U.S. Application Data

(60) Provisional application No. 62/012,500, filed on Jun. 16, 2014.

(51) Int. Cl.
*F21K 9/20* (2016.01)
*F21Y 103/10* (2016.01)
*F21Y 115/10* (2016.01)

(52) U.S. Cl.
CPC ..... *F21Y 2103/10* (2016.08); *F21Y 2115/10* (2016.08); *Y10T 29/49718* (2015.01)

(56) References Cited

U.S. PATENT DOCUMENTS 2,281,379 A 4/1942 Ohm
D133,216 S 7/1942 Parlato
D140,343 S 2/1945 Nitardy
2,525,537 A 10/1950 Fletcher
2,825,798 A 3/1958 Zingone
3,117,729 A 1/1964 Silvers et al.
3,159,352 A 12/1964 Wakefield et al.
3,299,264 A 1/1967 Lipscomb
4,053,762 A 10/1977 Barbson
4,323,954 A 4/1982 Florence et al.
4,338,653 A 7/1982 Marrero
5,025,355 A 6/1991 Harwood
5,381,320 A 1/1995 Jordan
5,791,764 A 8/1998 Jaksich
D399,586 S 10/1998 Ranieri et al.
D413,402 S 8/1999 Ranieri et al.
5,949,347 A 9/1999 Wu
6,036,336 A 3/2000 Wu
6,210,019 B1 4/2001 Weathers
6,305,816 B1 10/2001 Corcorran et al.
6,739,734 B1 5/2004 Hulgan
6,762,562 B2 7/2004 Leong
D496,121 S 9/2004 Santoro
6,853,151 B2 2/2005 Leong et al.
6,905,227 B2 6/2005 Wu
6,908,212 B2 6/2005 Schultz
6,929,382 B2 8/2005 Kuisma
6,936,968 B2 8/2005 Cross et al.
6,974,233 B1 12/2005 Aubrey
6,984,055 B2 1/2006 McCarthy et al.
7,049,761 B2 5/2006 Timmermans et al.
7,053,557 B2 5/2006 Cross et al.
7,067,992 B2 6/2006 Leong et al.
7,090,375 B2 8/2006 Kuisma
D541,467 S 4/2007 Gould
D541,468 S 4/2007 Mayfield, III et al.
D545,481 S 6/2007 Mayfield, III et al.
D545,482 S 6/2007 Mayfield, III et al.
D545,483 S 6/2007 Mayfield, III et al.
D545,485 S 6/2007 Hargreaves
7,229,192 B2 6/2007 Mayfield, III et al.
D545,992 S 7/2007 Mayfield, III et al.
7,318,661 B2 1/2008 Catalano
D561,930 S 2/2008 Hukle et al.
7,461,947 B2 12/2008 Wang et al.
7,488,086 B2 2/2009 Wu et al.
7,488,097 B2 2/2009 Reisenauer et al.
7,490,957 B2 2/2009 Leong et al.
7,507,001 B2 3/2009 Kit
7,520,636 B2 4/2009 Van Der Poel
7,530,716 B2 5/2009 Mayfield, III et al.
D597,701 S 8/2009 Tran et al.
D602,187 S 10/2009 Fabbri et al.
D602,188 S 10/2009 Fabbri et al.
7,597,456 B2 10/2009 Catalano et al.
7,607,796 B2 10/2009 Meyer
D604,000 S 11/2009 Fowler, Jr. et al.
7,614,769 B2 * 11/2009 Sell ..... F21S 8/026 362/147
7,635,198 B2 12/2009 Mayfield, III et al.
D608,932 S 1/2010 Castelli
7,674,005 B2 3/2010 Chung et al.
7,677,766 B2 3/2010 Boyer
D616,138 S 5/2010 Lasthein et al.
7,712,918 B2 5/2010 Siemiet et al.
D617,487 S 6/2010 Fowler, Jr. et al.
7,794,114 B2 9/2010 Medendorp, Jr.
7,845,832 B2 12/2010 Boyer
D643,572 S 8/2011 Lown et al.
D645,192 S 9/2011 Chung et al.
D646,421 S 10/2011 Chung et al.
D653,375 S 1/2012 Chung et al.
8,092,037 B2 1/2012 Kassay et al.
8,100,551 B2 1/2012 Mayfield, III et al.
D657,904 S 4/2012 Mayfield, III et al.
D660,497 S 5/2012 Chung et al.
D661,422 S 6/2012 Ferguson et al.
D661,423 S 6/2012 Ferguson et al.
D667,157 S 9/2012 Ferguson et al.
D671,258 S 11/2012 Ferrier et al.
D673,324 S 12/2012 Mayfield, III et al.
D685,122 S 6/2013 Kim et al.
D687,177 S 7/2013 Grandsart et al.
8,511,850 B2 8/2013 Hawkins et al.
8,523,383 B1 9/2013 Grigore et al.
D692,610 S 10/2013 Sitarski et al.
8,550,656 B2 10/2013 McCarthy, III et al.
8,585,241 B2 11/2013 Tsai
D701,341 S 3/2014 Mayfield, III et al.
8,672,508 B2 3/2014 Pearson et al.
D701,989 S 4/2014 Rodgers et al.
D701,990 S 4/2014 Rodgers et al.
8,696,154 B2 4/2014 Hutchens
8,764,220 B2 7/2014 Chan et al.
8,789,966 B2 7/2014 McCanless et al.
8,888,316 B2 11/2014 Handsaker
D721,198 S 1/2015 Glasbrenner
8,960,962 B2 2/2015 McCane et al.
9,062,867 B2 6/2015 Rodgers et al.
9,482,392 B2 * 11/2016 Baumeister ..... F21K 9/27
9,822,937 B2 * 11/2017 McCane ..... F21K 9/90
2005/0157498 A1 7/2005 Dicken
2006/0221606 A1 10/2006 Dowling
2008/0266849 A1 10/2008 Nielson et al.
2009/0002990 A1 1/2009 Becker et al.
2009/0034247 A1 2/2009 Boyer
2009/0046457 A1 2/2009 Everhart
2009/0086476 A1 4/2009 Tickner et al.
2009/0091929 A1 4/2009 Faubion
2009/0237922 A1 9/2009 Chiu
2009/0290348 A1 11/2009 Van Laanen et al.
2010/0014288 A1 1/2010 Kreutzer et al.
2010/0019689 A1 1/2010 Shan
2010/0033964 A1 2/2010 Choi et al.
2010/0053957 A1 3/2010 Pawelko et al.
2010/0103672 A1 4/2010 Thomas et al.
2010/0134046 A1 6/2010 Holder et al.
2010/0165616 A1 7/2010 Wilkinson et al.
2010/0172149 A1 7/2010 Siemiet et al.
2010/0237798 A1 9/2010 Wolf et al.
2010/0277082 A1 11/2010 Reed et al.
2010/0284181 A1 11/2010 O'Brien et al.
2010/0289428 A1 11/2010 Frazier et al.
2011/0141729 A1 6/2011 Yang et al.
2011/0228528 A1 9/2011 Yang et al.
2011/0310604 A1 12/2011 Shimizu et al.
2012/0113628 A1 5/2012 Burrow et al.
2012/0206909 A1 8/2012 Morgan
2012/0231693 A1 9/2012 Mellon
2012/0293999 A1 11/2012 Chung et al.
2013/0033861 A1 2/2013 Orton
2013/0044475 A1 2/2013 Hutchens
2013/0083524 A1 4/2013 Devorris
2013/0176716 A1 7/2013 Pratt et al.
2013/0223057 A1 8/2013 Gassner et al.
2013/0294059 A1 11/2013 Galluccio et al.
2014/0071669 A1 3/2014 McCarthy et al.
2014/0078727 A1 3/2014 Lu et al.
2014/0104825 A1 4/2014 Gassner et al.

(56) References Cited

U.S. PATENT DOCUMENTS

| | | | |
|---|---|---|---|
| 2014/0112014 | A1 | 4/2014 | Lin et al. |
| 2014/0119015 | A1 | 5/2014 | Morgan |
| 2014/0126195 | A1 | 5/2014 | Dixon |
| 2014/0126196 | A1 | 5/2014 | Dixon et al. |
| 2014/0126197 | A1 | 5/2014 | Dixon et al. |
| 2014/0126199 | A1 | 5/2014 | Heeter et al. |
| 2014/0160742 | A1* | 6/2014 | Rodgers ..... F21V 23/02 362/222 |
| 2014/0168961 | A1 | 6/2014 | Dubord |
| 2014/0204572 | A1 | 7/2014 | Spinelli |
| 2014/0226322 | A1 | 8/2014 | Chan et al. |
| 2014/0268748 | A1 | 9/2014 | Lay et al. |
| 2014/0355272 | A1 | 12/2014 | Chou |
| 2015/0003069 | A1 | 1/2015 | Medendorp, Jr. et al. |
| 2015/0003070 | A1 | 1/2015 | Medendorp, Jr. et al. |
| 2015/0016100 | A1 | 1/2015 | Ishii |
| 2015/0362132 | A1 | 12/2015 | McCane et al. |
| 2016/0033088 | A1 | 2/2016 | Mayfield, III et al. |

OTHER PUBLICATIONS

Amendment and Response to Office Action for U.S. Appl. No. 14/741,243, filed Apr. 26, 2017, 9 pages.
Notice of Allowance for U.S. Appl. No. 14/741,243, dated Jul. 27, 2017, 9 pages.

* cited by examiner

LIGHT ENGINE RETROFIT KIT AND METHOD FOR INSTALLING SAME

CROSS REFERENCE TO RELATED APPLICATIONS

This application is a continuation of U.S. patent application Ser. No. 14/741,243, filed on Jun. 16, 2015, entitled "Light Engine Retrofit Kit and Method for Installing Same" ("the '243 application"). This application claims the benefit of U.S. Provisional Application Ser. No. 62/012,500, filed on Jun. 16, 2014, entitled "Methods for Retrofitting a Luminaire with LEDs and Luminaires Containing the LEDs" ("the '500 application"). The disclosure of the '243 application and the '500 application are both hereby incorporated by reference in their entirety.

FIELD OF THE INVENTION

This invention relates to a retrofit kit for retrofitting an LED light engines into existing fixtures, particularly existing fluorescent light fixtures.

BACKGROUND

Traditional light fixtures presently used in a typical office or commercial environments comprise a troffer with at least one fluorescent lamp to illuminate a space. For many years the most common fluorescent lamps for use in indoor lighting have been the linear T5 (⅝ inch diameter), T8 (1 inch diameter), and the T12 (1½ inch diameter). Such bulbs are inefficient and have a relatively short lamp life. Thus, efforts have been made to identify suitable alternative illumination sources for indoor lighting applications. Light emitting diodes ("LEDs") have been identified as one alternative to traditional fluorescent bulbs.

An LED typically includes a diode mounted onto a die or chip, where the diode is surrounded by an encapsulant. The die is connected to a power source, which, in turn, transmits power to the diode. An LED used for lighting or illumination converts electrical energy to light in a manner that results in very little radiant energy outside the visible spectrum. LEDs are extremely efficient, and their efficiency is rapidly improving. For example, the lumen output obtained by 20 LEDs may soon be obtained by 10 LEDs.

However, in comparison to simply changing a light bulb in a conventional light fixture, exchanging an existing fluorescent fixture for a light fixture that uses LEDs as a light source can be labor intensive and costly. Such replacement typically requires access to the area above the ceiling. Environmental concerns, such as asbestos contamination and asbestos removal, become an issue when disturbing the ceiling. Moreover, the area above the ceiling collects dirt and dust, which can dislodge during LED replacement and thereby increase the time and cost of clean-up after installation. Additionally, exposed electrical wiring is common in such areas, which creates a safety hazard for workers removing old fixtures. A licensed electrician may be required to install the new fixtures based upon common safety codes. Thus, businesses and consumers are reticent to invest in a new LED light fixture when the effort and costs are compared to maintaining an existing fluorescent light fixture.

Efforts have also been made to retrofit an existing fluorescent light fixture with an LED light source. However, existing fluorescent light fixtures may come in any number of different sizes and configurations. Specifically, LED retrofit kits may not be generally compatible with existing fluorescent light fixtures. Oftentimes, a given LED retrofit kit may only be compatible with existing light fixtures that share a common mounting arrangement. Even if the LED retrofit kit is compatible, it may be difficult to install, particularly for a single worker. Therefore, there exists a need for an LED retrofit kit that is generally compatible with existing light fixtures, and that may be easily installed by a single worker.

SUMMARY

The terms "invention," "the invention," "this invention" and "the present invention" used in this patent are intended to refer broadly to all of the subject matter of this patent and the patent claims below. Statements containing these terms should be understood not to limit the subject matter described herein or to limit the meaning or scope of the patent claims below. Embodiments of the invention covered by this patent are defined by the claims below, not this summary. This summary is a high-level overview of various aspects of the invention and introduces some of the concepts that are further described in the Detailed Description section below. This summary is not intended to identify key or essential features of the claimed subject matter, nor is it intended to be used in isolation to determine the scope of the claimed subject matter. The subject matter should be understood by reference to appropriate portions of the entire specification of this patent, any or all drawings and each claim.

Embodiments of the invention provide retrofit kits for retrofitting LED light engines into existing light fixture housings. The retrofit kit includes a hook bracket that may be mounted in the housing and from which an end of the LED light engine can be suspended so as to permit an installer to electrically connect the LED light engine. The retrofit kit also includes a mounting bracket to secure the free end of the LED light engine into the housing after the LED light engine has been rotated upwardly into the housing from the hanging position.

DETAILED DESCRIPTION

Figures 1, 1A:
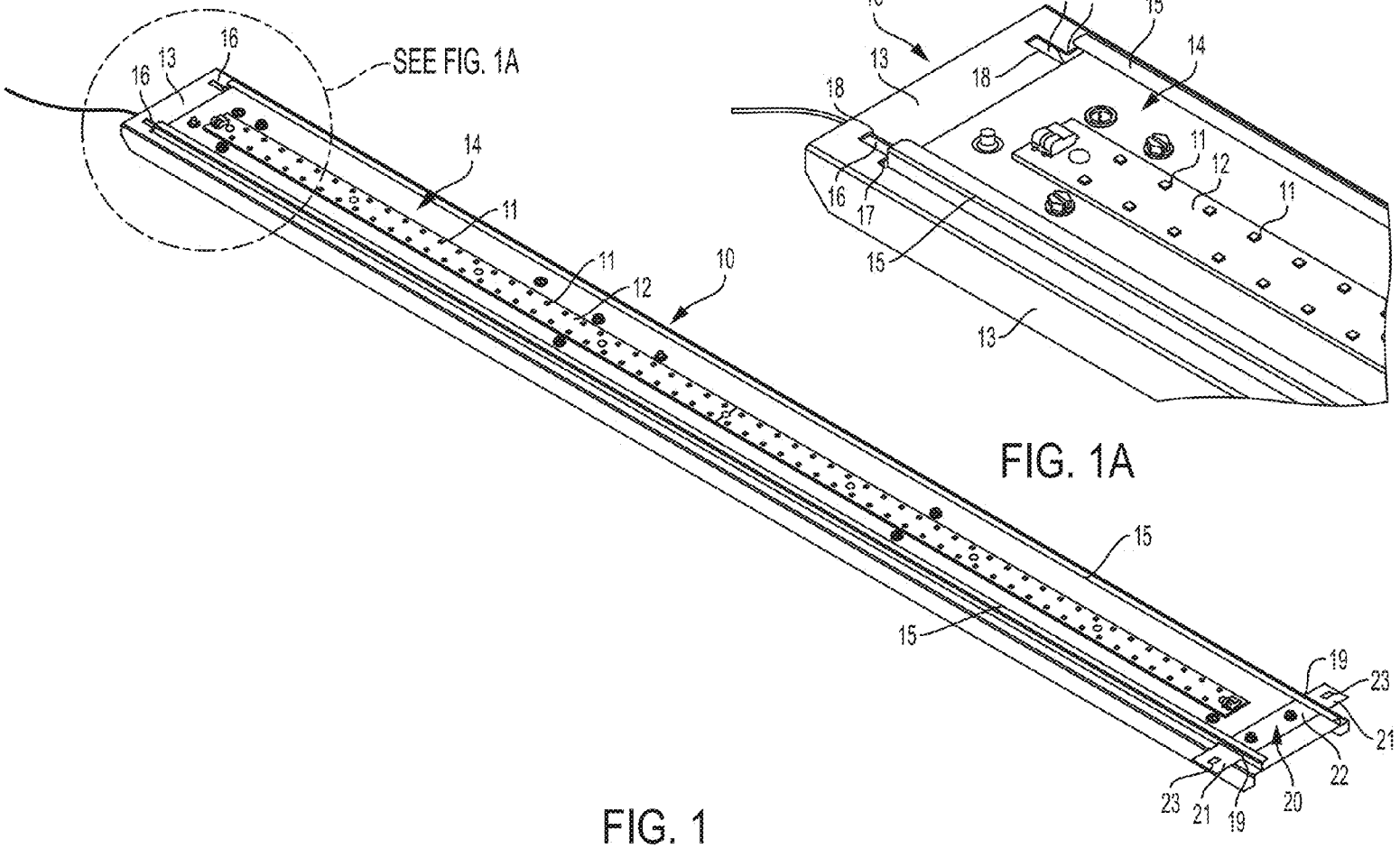
FIG. 1 is a top perspective view of a light engine according to an embodiment of the present invention.
FIG. 1A is a detail view of an end of the light engine of FIG. 1.

The subject matter of embodiments of the present invention is described here with specificity to meet statutory requirements, but this description is not necessarily intended to limit the scope of the claims. The claimed subject matter may be embodied in other ways, may include different elements or steps, and may be used in conjunction with other existing or future technologies. This description should not be interpreted as implying any particular order or arrangement among or between various steps or elements except when the order of individual steps or arrangement of elements is explicitly described.

Embodiments of the present invention relate to retrofit kits for retrofitting existing luminaires containing fluorescent or other light sources with light emitting diode ("LED") based light sources. Some embodiments of the retrofit kit include (1) a light engine 10; (2) a mounting bracket 20; (3) a hook bracket 30; and (4) a lens 40.

As shown in FIGS. 1 and 1A, embodiments of the light engine 10 include a light engine base 13. The light engine base 13 may be formed of any material having the requisite structural integrity and thermal management capabilities so as to conduct heat generated by the LEDs 11. For example, in some embodiments, the light engine base 13 is formed from metallic materials, such as but not limited to steel, aluminum, etc.

In the illustrated embodiment, a separate lens retaining channel 14 is mounted on the base 13. The lens retaining channel 14 includes upstanding lens retainer flanges 15 that help to retain lens 40, as discussed in more detail below. One of skill in the art will understand that the base 13 and lens retaining channel 14 could be integrally-formed such that the lens retainer flanges 15 extend directly from the base 13.

At least one printed circuit board ("PCB") 12 populated with a plurality of LEDs 11 is mounted on the lens retaining channel 14 (or directly on the base 13 if the lens retaining channel 14 and base 13 are integrally formed). Each PCB 12 can have wiring for connecting to a power supply, which can be shared between PCBs 12 or each PCB 12 could have its own power supply. The LEDs 11 may be single-die or multi-die LEDs, DC or AC, or can be organic light emitting diodes. White, color, or multicolor LEDs 11 may be used. Moreover, the LEDs 11 mounted on a PCB 12 need not all be the same color; rather, mixtures of LEDs 11 may be used. Furthermore, in some embodiments no PCB 12 is needed; rather, the LEDs 11 are chip-on-board LEDs.

The light engine base 13 is sized to fit within the channel of an existing light fixture. The light engine base 13 may be formed to fit within specific housing dimensions (e.g., 1×4, 1×8, etc.) or it may be provided in a size that generally will fit within most generic existing light fixtures (e.g., it will universally fit with existing fixtures).

Figure 1B:
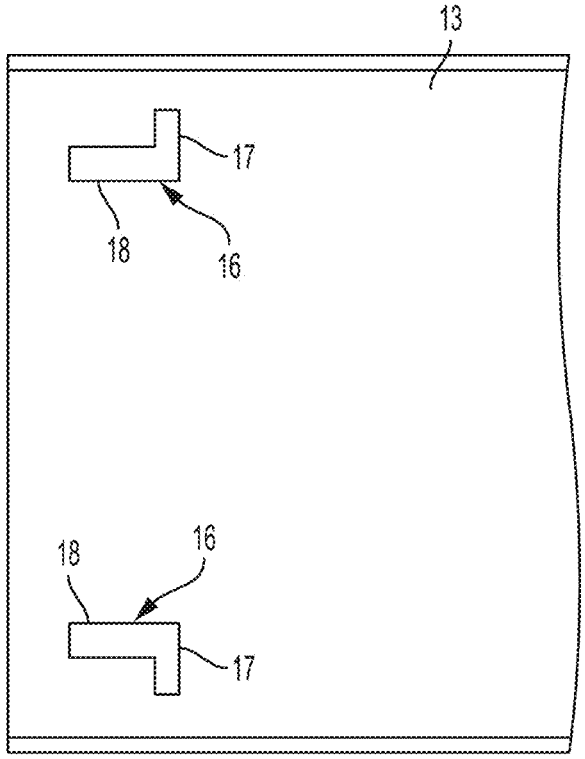
FIG. 1B is a detail view of the apertures of the light engine of FIG. 1.

Apertures 16 are formed in one end of the light engine base 13. As shown in FIG. 1B, the apertures 16 may be L-shaped so as to have a wide portion 17 and a narrow portion 18, though it should be appreciated that the apertures 16 may take on any other shape as desired or required for a particular application. For example, in certain embodiments the apertures 16 may be T-shaped. The apertures 16 are designed to receive hooks 31 located on the hook bracket 30, as described in more detail below.

Mounting bracket 20 is associated with the light engine 10, typically but not necessarily proximate the end of the light engine base 13 opposite the apertures 16. The mounting bracket 20 is designed to help secure the light engine 10 (and more specifically, in some embodiments one end of the light engine 10) within an existing fixture housing 50. In the illustrated embodiment, the mounting bracket 20 extends across the light engine 10 via clearance slots 19 provided in the lens retainer flanges 15. Once inserted through the slots 19, mounting bracket wings 21 extend from each side of the light engine 10. In some embodiments, the clearance slots 19 are wider than the mounting bracket 20 so as to permit translation of the mounting bracket 20 within the clearance slot 19 for positioning purposes (if needed). In other embodiments, discrete mounting bracket wings 21 may be mounted or otherwise provided on the light engine 10 and need not be connected by the central portion 22 of the mounting bracket 20 (such clearance slots 19 in the lens retainer flanges 15 are not needed in such embodiments).

Fastener apertures 23 are provided on each mounting bracket wing 21 and are designed to receive a fastener 24 (e.g., screws, self-tapping screws, bolts, pins, rivets, or any other mechanical fastening device) that engages both the mounting bracket 20 and existing housing 50 so as to retain the light engine 10 in the existing housing 50. In an alternative embodiment, the mounting bracket 20 may be configured to snap into the housing of an existing light fixture.

Figure 2:
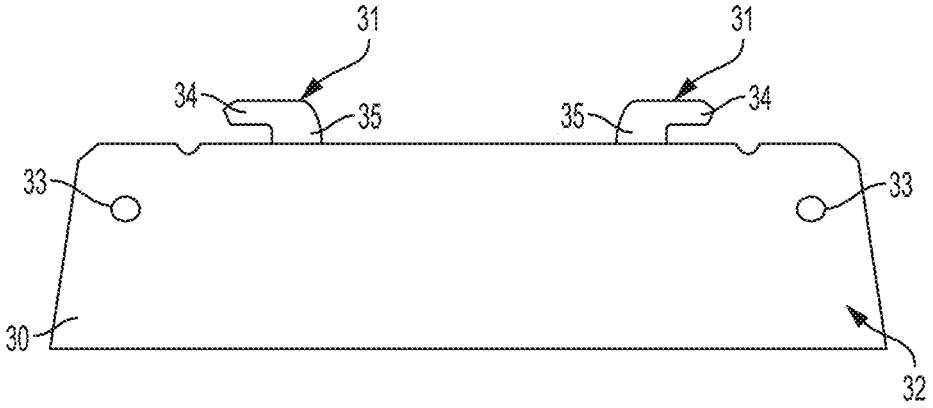
FIG. 2 is an end view of one embodiment of a hook bracket.

FIG. 2 is a side elevation view of an embodiment of a hook bracket 30 used to help retain the light engine 10 within an existing fixture housing 50. The disclosed hook bracket 30 includes a plate 32 having optional fastener apertures 33, each fastener aperture 33 for receiving a fastener 36 for attaching the hook bracket 30 to an existing light fixture housing 50 (as discussed below). While fastener apertures 33 are the illustrated attachment mechanism, in some embodiments the hook bracket 30 may be configured instead to snap-fit to an existing light fixture housing 50 without the need for additional mechanical fasteners.

Hooks 31 extend from plate 32 of the hook bracket 30. In certain embodiments, the hooks 31 will extend coplanar with the plate 32, while in other embodiments the hooks 31 will extend at an angle (e.g., anywhere greater than 0° up to 90°) relative to the plate 32 (i.e., the hooks 31 are upstanding from the plate 32). In cases where the hooks 31 are coplanar with the plate 32, the hook bracket 30 may be mounted at an angle so that the hooks 31 will extend at an angle (e.g., anywhere greater than 0° up to 90°) relative to the housing 50. The illustrated hooks 31 are L-shaped and have a wide portion 34 and a narrow portion 35. During installation, hook bracket 30 is installed in an housing such that the hooks 31 extend upwardly in the housing. The light engine 10 is suspended from the hooks 31 of the hook bracket 30 by engagement of the hooks 31 within the apertures 16 of the light engine 10. The hooks 31 may be L-shaped, as shown, or take on any other shape as desired or required for a particular application so long as the hooks 31 can interlock with the apertures 16 on a light engine 10 to retain the light engine 10 in a hanging position. For example, in certain embodiments, the hooks 31 may be T-shaped to complement T-shaped apertures 16 in the light engine 10. In some embodiments, the hooks 31, and corresponding apertures 16, may also comprise a simple rectangular shape without a change in width. Regardless, of the hook shape, one end of the light engine 10 is positioned on the hook bracket 30 such that the hooks 31 engage with the apertures 16 on the light engine 10 and the opposed end of the light engine 10 is free-hanging. When the light engine 10 is in a hanging position, the upstanding hooks 31 serve as stops that engage the edge of the apertures 16 to prevent any downward movement of the light engine 10. The light engine 10 will not disengage from the hooks 31 unless the light engine 10 is lifted upwardly so that the apertures 16 may pass over the upstanding hooks 31.

Figure 3:
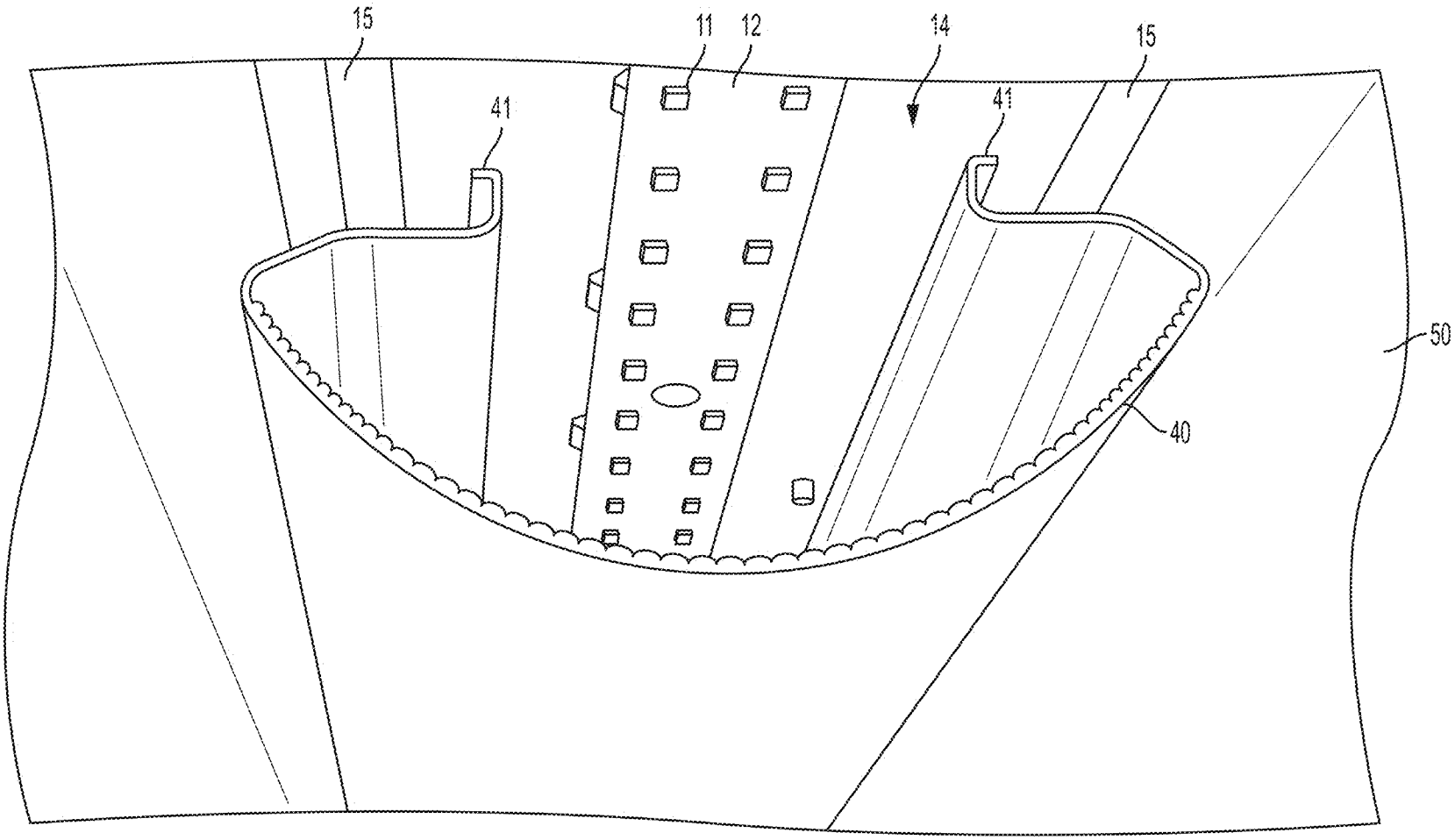
FIG. 3 is a bottom perspective view of the installation of a lens onto a light engine.

As shown in FIG. 3, some embodiments of the retrofit kit also include a lens 40 positioned over the LEDs 11. The lens 40 may serve both as an aesthetic cover and to functionally direct or diffuse light to provide better lighting conditions. The lens may be of any type (diffuse, prismatic, etc.) that achieves the desired light emission from the fixture. In certain embodiments, lens wings 41 may be provided along opposing edges of the lens 40. The lens wings 41 seat within the lens retainer flanges 15 of the lens retaining channel 14 so as to retain the lens 40 to the light engine 10 For example, in some embodiments, the lens 40 may be mounted on the light engine 10 by inserting the lens wings 41 into lens retainer flanges 15 at an end of the light engine 10 and then sliding the lens 40 lengthwise along the light engine 10. In other embodiments, the lens may be compressed such that the lens wings 41 can be positioned between the lens retainer flanges 15. Upon release, the lens wings 41 extend outwardly and seat within lens retainer flanges 15. Such a snap-fit arrangement may be performed prior to or after installation of the light engine 10 into an existing housing 50. However, the lens 40 may be affixed or otherwise secured to the light engine 10 in other ways, including with mechanical fasteners (e.g., screws, self-tapping screws, bolts, pins, rivets, or any other mechanical fastening device).

The retrofit kits disclosed herein may be installed in existing fixture housings of any dimensions, including but not limited to 1×4, 1×8, 2×4, etc. In some embodiments, a single retrofit kit is provided in a fixture. However, it will be appreciated that multiple retrofit kits may be installed in longer fixtures (e.g., 1×8 fixtures).

Prior to installation, the existing light fixture is stripped of its existing light sources and their associated wiring and electronics. The method of stripping the existing light fixture will vary depending upon the particular type of light sources, their associated hardware and electrical connections, and the configuration of the existing light fixture. Generally, the process for removal of the lighting elements from an existing light fixture will include: (i) removing electrical power from the existing light fixture housing 50; (ii) disconnecting any light sources and associated hardware from the existing light fixture; and (iii) removing unnecessary brackets or hardware, if any, from the housing 50. The remaining housing 50 is then in a bare condition and ready to receive the retrofit kit.

Figure 4:
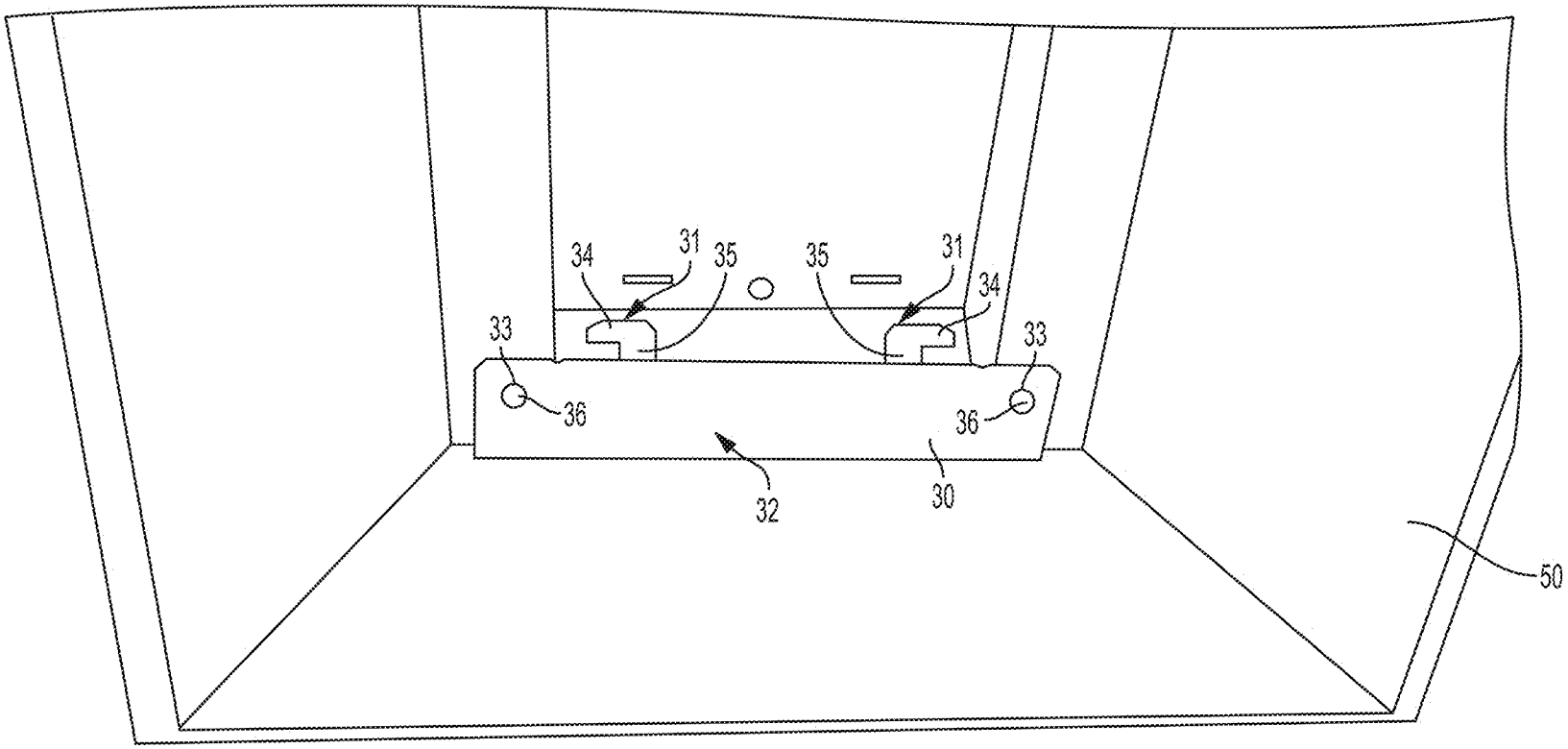
FIG. 4 is a bottom perspective view of the hook bracket of FIG. 2 installed in a fixture housing.

The hook bracket 30 is then installed into the housing 50. If a single retrofit kit is to be installed in the housing 50, the hook bracket 30 may be mounted at either end of the housing 50. FIG. 4 illustrates a hook bracket 30 mounted on the end of a housing 50, with its hooks 31 projecting upwardly. The installation location of the hook bracket 30 need not always be at the end but rather may be adjusted within the housing 50 so as to center or offset the light engine 10 in the housing 50.

In certain embodiments (such as longer fixture housing 50), multiple retrofit kits may be necessary such that multiple light engines 10 are installed in a series arrangement (i.e., end-to-end) within the housing 50. Each light engine 10 may be held within the housing 50 via its own mounting bracket 20 and hook bracket 30. While hook brackets 30 (one from each retrofit kit) could be installed on opposing ends of the housing 50 and the mounting brackets 20 positioned more centrally in the housing 50, in other embodiments the mounting brackets 20 are positioned on opposing ends of the housing 50 and the hook brackets 30 are positioned more centrally. The basic installation of the retrofit kit (as discussed below) remains the same regardless of the location of the hook bracket 30 and mounting bracket 20 within the housing 50.

Referring to FIG. 4, the hook bracket 30 may be mounted to the housing 50 by installing fasteners 36, including, but not limited to screws, self-tapping screws, bolts, pins, rivets, or any other mechanical fastening device, through fastener apertures 33 of hook bracket 30. The hook bracket 30 should be oriented such that the hooks 31 extend upwardly in the housing 50.

Figure 5:
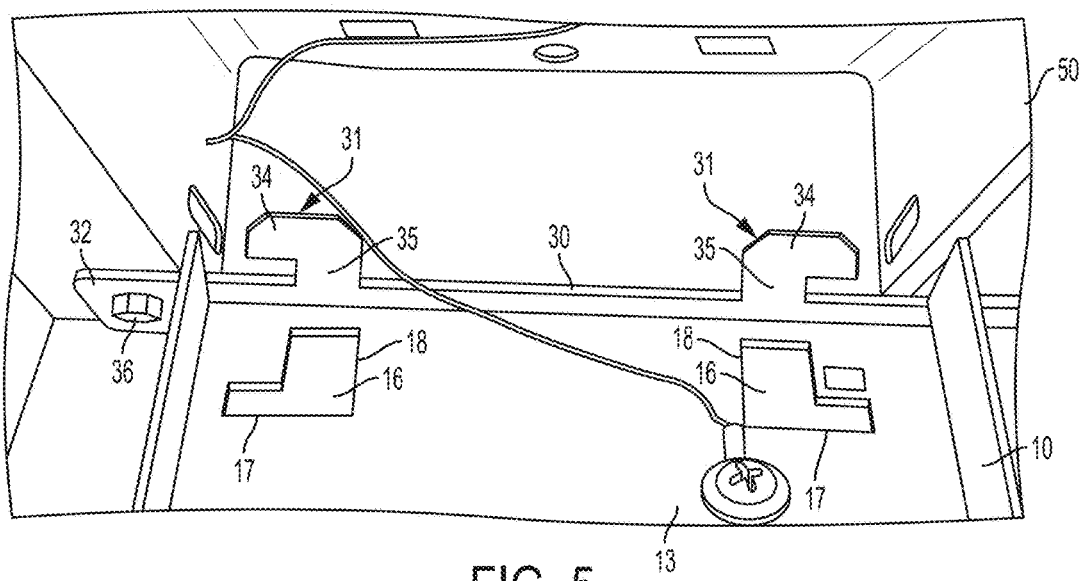
FIG. 5 is a bottom perspective view of the light engine of FIG. 1 adjacent the hook bracket of FIG. 2, immediately prior to engagement, according to an embodiment of the present invention.
Figure 6:
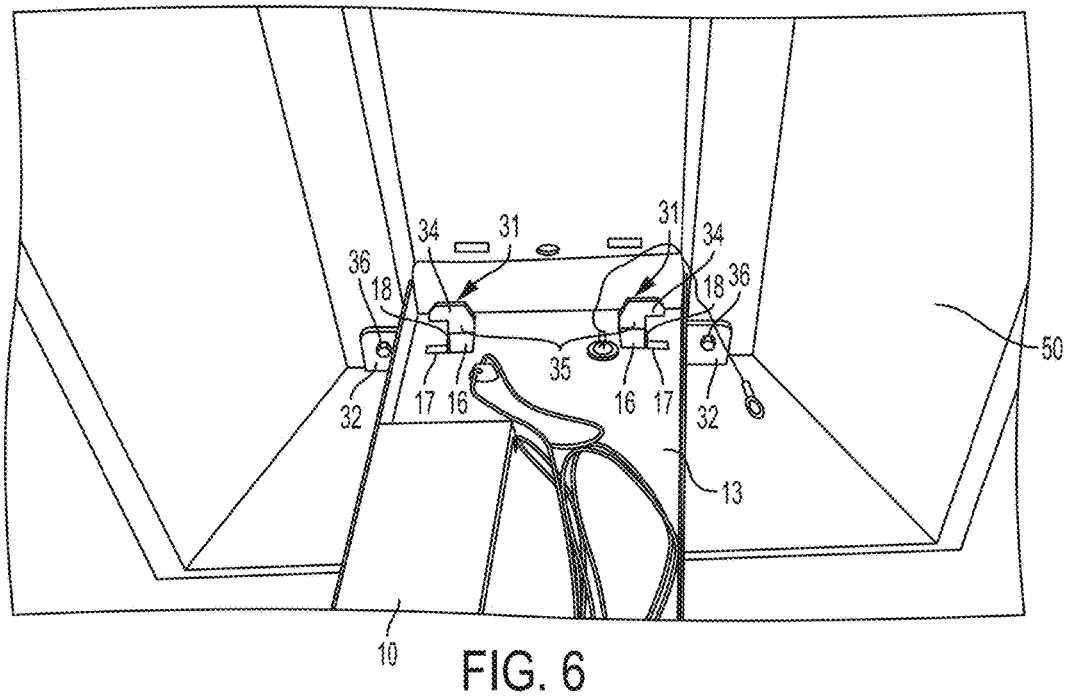
FIG. 6 is a bottom perspective view of the light engine of FIG. 1 engaged with the hook bracket of FIG. 2, according to an embodiment of the present invention.

As shown in FIGS. 5-8A, after the hook bracket 30 has been installed in the housing 50, the light engine 10 is suspended from the hook bracket 30 by positioning the hooks 31 on the hook bracket 30 within the apertures 16 on the light engine 10 (FIG. 5). The light engine 10 should be oriented such that the LEDs 11 emit light downwardly upon installation of the retrofit kit. As discussed above, the wide portion 34 of the L-shaped hook 31 is inserted into the wide portion 17 of the aperture 16. After insertion, the light engine 10 can be rotated downwardly. The light engine 10 is prevented from disengaging from the hook bracket 30 because, after rotation, the hook 31 and the aperture 16 are no longer aligned and thus hook 31 cannot pass back through the aperture 16. Moreover, the hooks 31 serve as a stop to restrict downward movement of the light engine 10. Thus, after engagement of the hooks 31 and the apertures 16 (FIG. 6), the light engine 10 may freely hang from the hooks 31 without any additional support.

In certain embodiments, the apertures 16 and hooks 31 may have wide portions 17, 34 and narrow portions 18, 35. These wide 17, 34 and narrow 18, 35 portions may serve to provide additional interlocking functions to reduce the potential for the apertures 16 to disengage from the hooks 31 and unintentionally release the light engine 10. To engage or disengage the hooks 31 from the apertures 16, the light engine 10 would need to be aligned both angularly (i.e., to an angular position that is relatively above that of hanging) and longitudinally to align the wide portion 17 of the aperture 16 with the wide portion 34 of the hook 31. In these embodiments, if the wide portion 17 of the aperture 16 is not aligned with the wide portion 34 of the hook 31, the interference between the wide portion 34 of the hook 31 with the narrow portion 18 of the aperture 16 will prevent the aperture 16 from inadvertently being lifted off the hook 31 and releasing the light engine 10.

Figure 7:
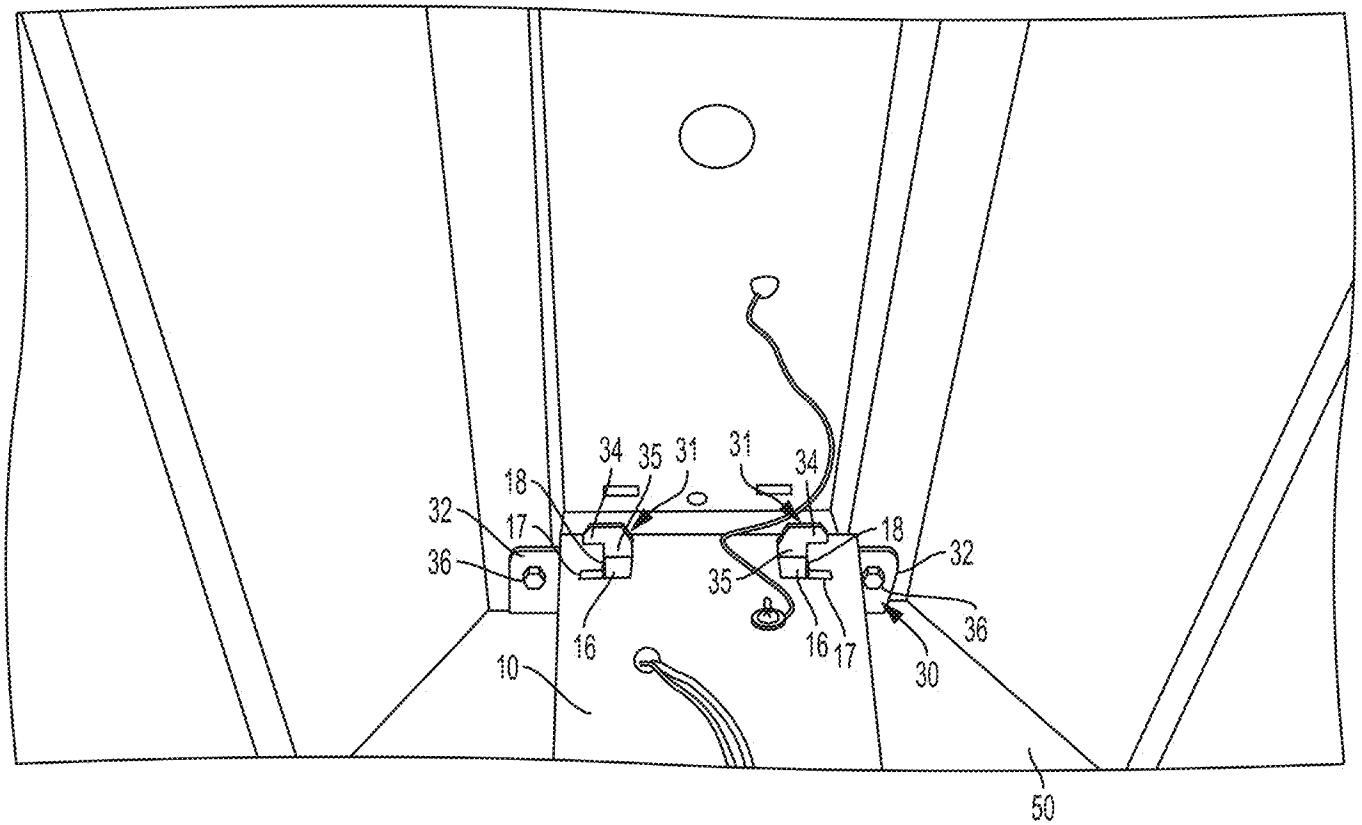
FIG. 7 is a bottom perspective view of the light engine of FIG. 1 supported by the hook bracket of FIG. 2, according to an embodiment of the present invention.
Figure 8A:
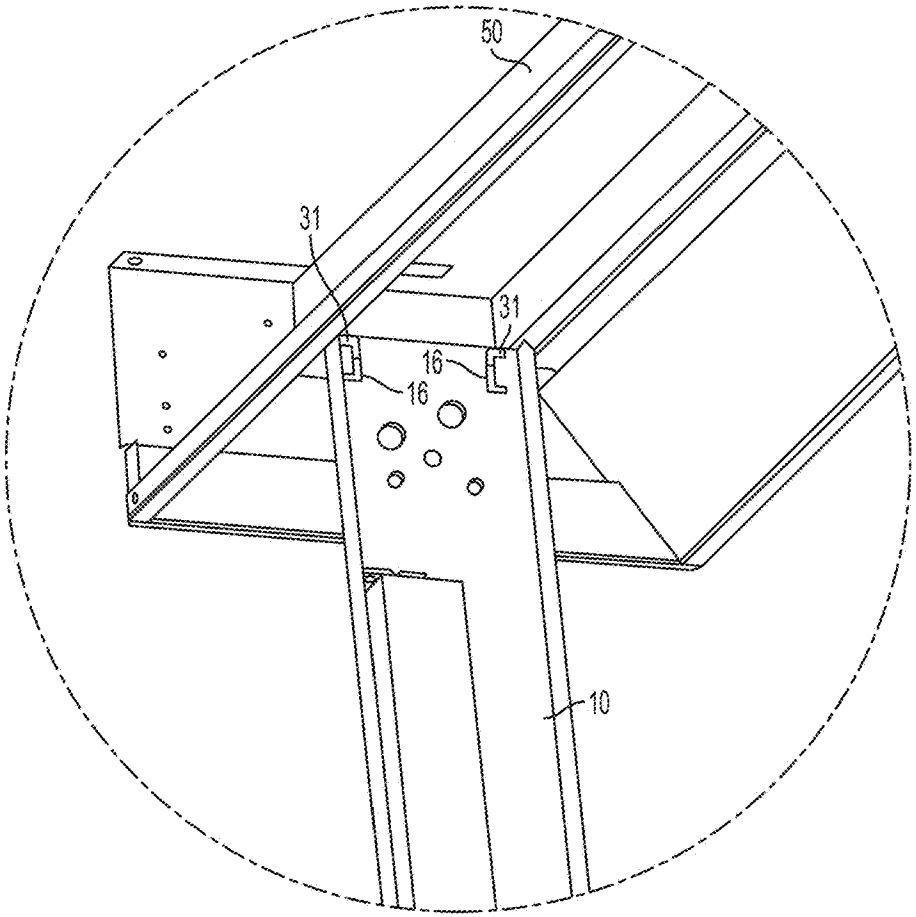
FIG. 8A is a detail view of the engagement between a light engine and a hook bracket installed in a light fixture housing.
Figure 8:
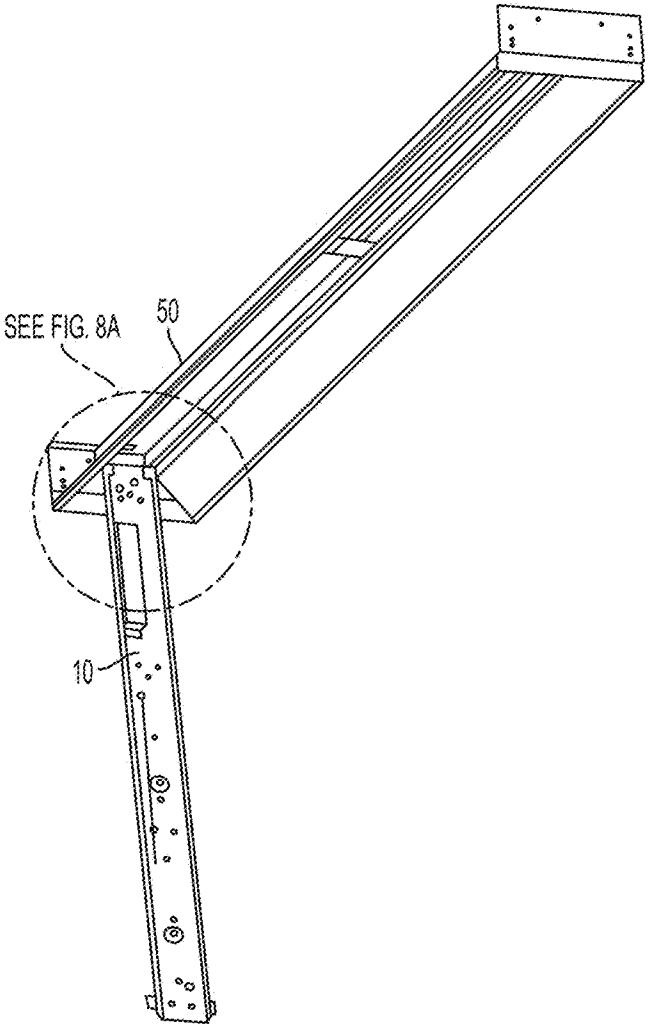
FIG. 8 is a bottom perspective view of a light engine hanging from a hook bracket.

Referring to FIGS. 7-8A, the light engine 10 is in a hanging position where the rear or top portion of the light engine 10 is exposed. In this position, a single worker may complete any necessary electrical connections for the light engine 10 without the need to support the light engine 10 or to use specialized tools or assistance.

After the completion of the necessary electrical connections, the light engine 10 may be rotated upwardly into position within the housing 50. During this rotation, the narrow portion 35 of hook 31 can translate within the narrow portion 18 of aperture 16 if such movement is needed to properly position the light engine 10. Abutment between the wide portion 34 of hook 31 and the narrow portion 18 of aperture 16 prevents disengagement of the hook 31 from the aperture 16 and thus retains that end of the light engine 10 in the housing 50. During the rotation of the light engine 10, a worker may feed any wires, tethers, connectors, or the like up into the channel or other space within the housing 50.

Figure 9:
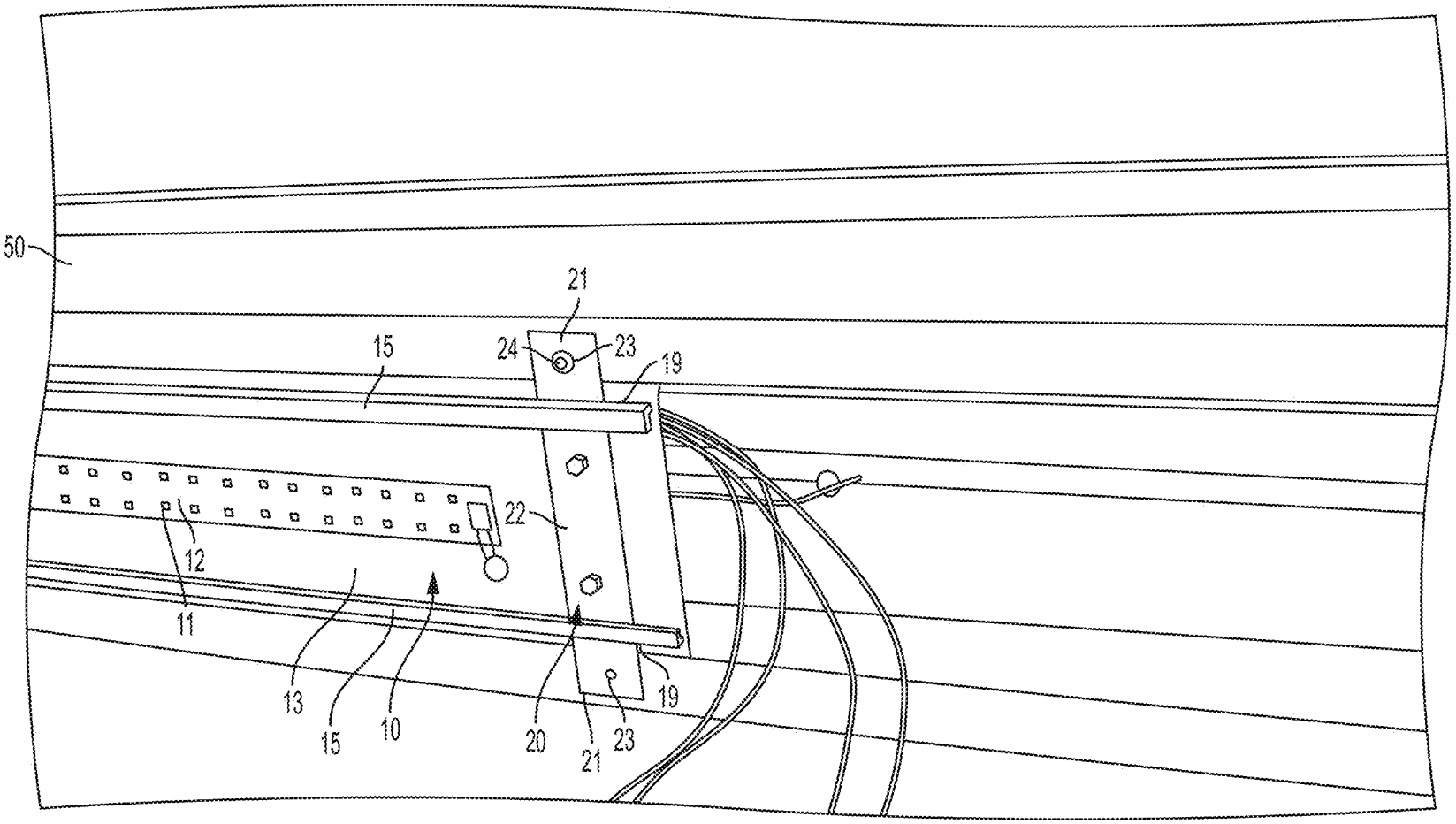
FIG. 9 is a bottom perspective view of a light engine with mounting bracket installed in a light fixture housing.
Figure 10:
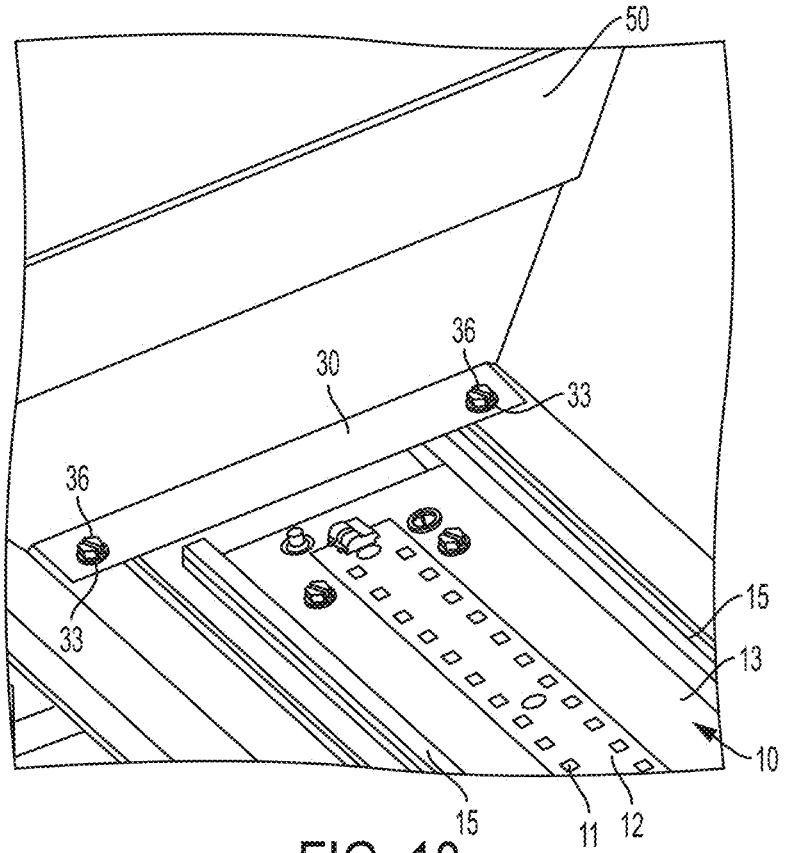
FIG. 10 is a detail view of the interface of a light engine with a hook bracket installed in a light fixture housing according to an embodiment of the present invention.
Figure 11:
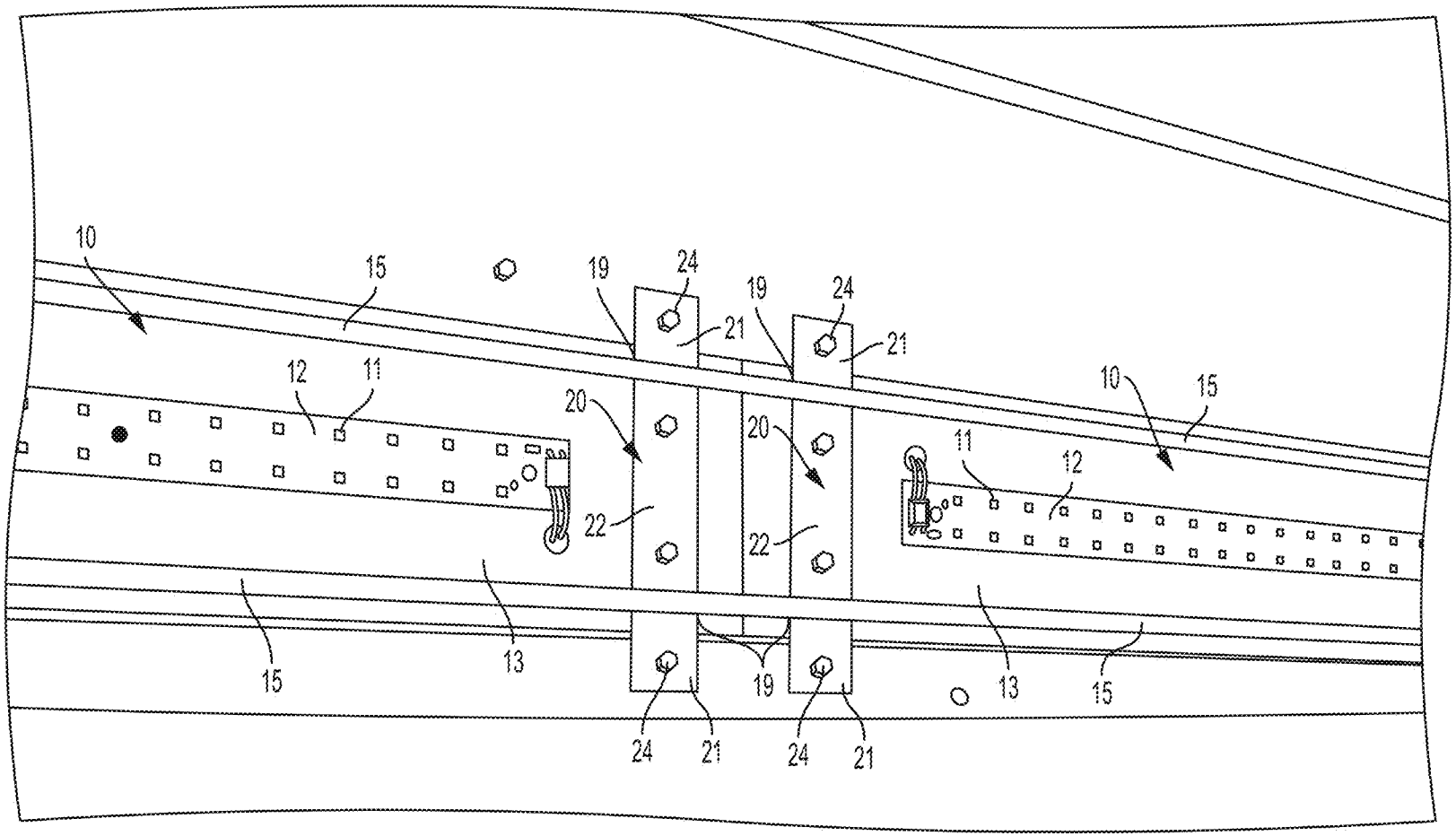
FIG. 11 is a bottom perspective view of multiple light engines installed in a light fixture housing.

Referring to FIGS. 9-11, after the light engine 10 has been rotated into a position within the housing 50, the mounting bracket 20, located on the free-hanging end of the light engine 10 during the above described installation, may be affixed to the housing 50 by installing fasteners 24 through fastener apertures 23. When the fasteners 24 are installed through the fastener apertures 23 into the housing 50, the light engine 10 position may be adjusted to ensure proper alignment and clearance because the opposing end of the light engine 10 is supported by the hooks 31 of the hook bracket 30. The hooks 31 may slide or translate within apertures 16 to allow minor adjustments at the final stage of installation.

FIG. 10 is a detail view of the connection between the light engine 10 and the hook bracket 30 after the light engine 10 has been rotated into a position within the housing 50. The hook bracket 30 remains affixed to the housing 50 with fasteners 36 passing through fastener apertures 33. When the light engine 10 is rotated up into position within the housing 50, the hooks 31 remain engaged with the apertures 16 and provide support to the light engine 10. The light engine 10 is then supported by the housing 50 through the hook bracket 30.

As mentioned above, in certain embodiments, multiple light engines 10 may be installed in series into a single housing 50, such as shown in FIG. 11. Depending upon space constraints and the necessary wiring and electrical connections, the light engines 10 may be oriented with their mounting brackets 20 located centrally within the housing 50 (FIG. 11). However, it should be appreciated that any relative orientation of the light engines 10 may be used. For example, the light engines 10 may be arranged such that both hook brackets 30 are centrally located, or such that one hook bracket 30 and one mounting bracket 20 are centrally located.

Referring to FIGS. 1-11, the light engine 10 shown and described above may include a plurality of downward-facing LEDs 11. It will be recognized, however, that other configurations are possible. For example, the LEDs 11 or light elements may be configured to face sideward and/or upward such that they emit light towards a reflective surface that directs light from the LEDs 11 downward and out of the housing 50. Examples of such embodiments are described in U.S. application Ser. No. 13/828,550, filed Mar. 14, 2013 and published as US 2013/0294053 on Nov. 7, 2013 ("LED light fixture"), the contents of which are incorporated herein by this reference in their entirety. In such embodiments, the reflector may be integral with the light engine 10 or the housing 50.

Figure 12:
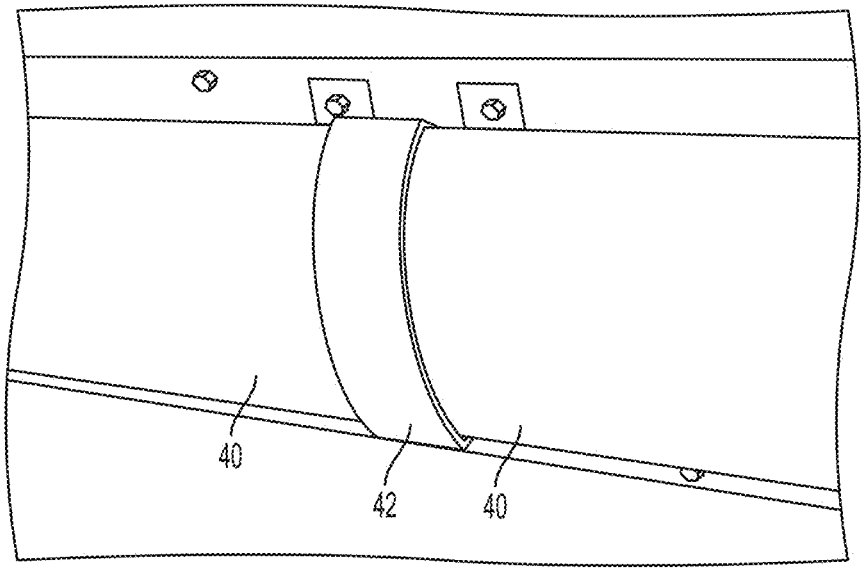
FIG. 12 is a bottom perspective view of a light trap engaged with two lenses.

The lens 40 may be positioned on the light engine 10 (as discussed above) before or after the light engine 10 is installed within the housing 50. As shown in FIG. 12, a light trap 42 may be used to cover any gaps between lenses 40 of adjacent retrofit kits or between an end of a lens 40 and the housing 50 so as to prevent light emitted by the LEDs 11 from escaping the housing 50. Exemplary light trap 42 configurations are described in U.S. application Ser. No. 13/833,201, filed Mar. 15, 2013 and published as US 2014/0104843 on Apr. 17, 2014 ("Ceiling mount fixture"), the contents of which are incorporated herein by this reference in their entirety.

Different arrangements of the components depicted in the drawings or described above, as well as components and steps not shown or described are possible. Similarly, some features and subcombinations are useful and may be employed without reference to other features and subcombinations. Embodiments of the invention have been described for illustrative and not restrictive purposes, and alternative embodiments will become apparent to readers of this patent. Accordingly, the present invention is not limited to the embodiments described above or depicted in the drawings, and various embodiments and modifications can be made without departing from the scope of the claims below.

That which is claimed is:

1. A retrofit kit comprising:

a linear light engine comprising a light engine base having a first end and a second end, wherein the first end comprises at least one aperture; and a hook bracket comprising a base and at least one hook extending from the base, wherein the hook bracket is configured to be installed in an existing light fixture housing such that the at least one hook extends upwardly within the existing light fixture housing, wherein the at least one hook is configured to engage the at least one aperture in the first end of the light engine base and support the light engine by the first end in a hanging orientation within the existing light fixture housing, and wherein, from the hanging orientation, the light engine is pivotable upwardly relative to the hook bracket so that the second end of the light engine base may be secured to the existing light fixture housing.

2. The retrofit kit of claim 1, wherein the at least one hook comprises a wide hook portion and a narrow hook portion.

3. The retrofit kit of claim 2, wherein the at least one hook is L-shaped or T-shaped.

4. The retrofit kit of claim 2, wherein the at least one aperture comprises a wide aperture portion and a narrow aperture portion.

5. The retrofit kit of claim 1, further comprising a mounting bracket adapted to secure the second end of the light engine base to the existing light fixture housing.

6. The retrofit kit of claim 5, wherein the mounting bracket further comprises at least one fastener aperture.

7. The retrofit kit of claim 1, wherein the retrofit kit further comprises a lens.

8. The retrofit kit of claim 7, wherein the lens comprises lens wings that extend along opposing edges of the lens.

9. The retrofit kit of claim 8, wherein the light engine base further comprises lens retainer flanges that extend upwardly from the light engine base and wherein the lens retainer flanges receive the lens wings to retain the lens on the light engine.

10. The retrofit kit of claim 1, wherein the light engine base is removable from the hook bracket.

11. The retrofit kit of claim 1, wherein the hook of the hook bracket extends at a non-zero angle relative to the base of the hook bracket.

12. The retrofit kit of claim 1, wherein the light engine further comprises a plurality of light emitted diodes extending along the light engine base.

13. A method for installing a retrofit kit into an existing light fixture housing, the retrofit kit comprising:

a light engine comprising a light engine base having a first end and a second end, wherein the first end comprises at least one aperture; and a hook bracket comprising a base plate and at least one hook extending from the base plate, wherein the method comprises:

affixing the base plate of the hook bracket to the existing light fixture housing such that the at least one hook extends upwardly within the existing light fixture housing; and engaging the first end of the light engine base with the hook bracket by engaging the at least one hook of the hook bracket with the at least one aperture on the first end of the light engine base so as to support the light engine by the first end in a hanging orientation within the existing light fixture housing.

14. The method of claim 13, further comprising:

connecting the light engine to an electrical power source;

rotating the light engine upwardly into the existing light fixture housing; and affixing the second end of the light engine to the existing light fixture housing with the mounting bracket.

15. The method of claim 14, further comprising installing a lens onto the light engine.

16. The method of claim 15, wherein the light engine base further comprises lens retainer flanges that extend upwardly from the light engine base and wherein the lens comprises lens wings that extend along opposing edges of the lens, wherein installing the lens comprises positioning the lens wings within the lens retainer flanges.

17. The method of claim 15, wherein installing the lens comprises snap-fitting the lens to the light engine.

18. The method of claim 15, further comprising installing a light trap between an end of the lens and the existing light fixture housing.

19. The method of claim 13, wherein the second end of the light engine base comprises a mounting bracket, and wherein the light engine further comprises a plurality of light emitted diodes extending along the light engine base.

20. A retrofit kit comprising:

a light engine comprising a light engine base having a first end and a second end, wherein the first end comprises at least one aperture; and a hook bracket comprising a base plate and at least one hook extending from the base plate, wherein the hook bracket is configured to be installed in an existing light fixture housing via the base plate such that the at least one hook extends upwardly within the existing light fixture housing, wherein the at least one hook is configured to engage the at least one aperture in the first end of the light engine base and support the light engine by the first end in a hanging orientation within the existing light fixture housing.

* * * * *